US007600660B2

(12) United States Patent
Kasper et al.

(10) Patent No.: US 7,600,660 B2
(45) Date of Patent: Oct. 13, 2009

(54) HARNESS TIGHTENING SYSTEM

(76) Inventors: Raymond Nevin Kasper, P.O. Box 2345, 13324 Burma Rd., Vashon, WA (US) 98070; John D. Martin, 10308 SW. 116th St., Vashon, WA (US) 98070

( * ) Notice: Subject to any disclaimer, the term of this patent is extended or adjusted under 35 U.S.C. 154(b) by 489 days.

(21) Appl. No.: 11/027,700

(22) Filed: Dec. 28, 2004

(65) Prior Publication Data

US 2005/0279797 A1 Dec. 22, 2005

Related U.S. Application Data

(63) Continuation-in-part of application No. 10/903,491, filed on Nov. 26, 2004, now abandoned.

(60) Provisional application No. 60/552,218, filed on Mar. 11, 2004.

(51) Int. Cl.
*B65H 75/40* (2006.01)

(52) U.S. Cl. ..... 224/162; 224/631; 224/637; 2/338

(58) Field of Classification Search ..... 224/162, 224/631, 637, 176, 221; 280/621, 622; 2/310, 2/311, 338, 44, 321, 337, 317; 182/3, 231, 182/232; 114/39.18
See application file for complete search history.

(56) References Cited

U.S. PATENT DOCUMENTS 1,622,954 A * 3/1927 Macheroux ..... 24/163 R
3,386,683 A * 6/1968 Howland ..... 242/374
RE26,584 E * 5/1969 Spence ..... 24/68 J
4,976,383 A * 12/1990 Norris ..... 224/640
5,027,874 A * 7/1991 Gazzola ..... 224/162
6,267,390 B1 * 7/2001 Maravetz et al. ..... 280/14.21
6,328,193 B1 * 12/2001 Schiff ..... 224/660
2004/0182968 A1 * 9/2004 Gentry ..... 244/155 A
2005/0237864 A1 * 10/2005 Albisetti ..... 368/282
2006/0053531 A1 * 3/2006 McBride et al. ..... 2/317

FOREIGN PATENT DOCUMENTS

FR 2830171 A1 * 4/2003
JP 2006-149913 A * 6/2006

* cited by examiner

*Primary Examiner*—Nathan J Newhouse
*Assistant Examiner*—Corey N Skurdal
(74) *Attorney, Agent, or Firm*—Black Lowe & Graham PLLC

(57) ABSTRACT

The present disclosure provides a harness adjustment system that may be used in various applications including backpacks, windsurf harnesses, kite-board harnesses, mountain climbing harnesses, utility harnesses, backpack shoulder straps, tie-down straps, and various belts for numerous applications. The harness adjustment system includes a first webbing strap, a winding reel, a cable tension member, and a strap lock. The winding reel is secured to a first portion of the strap. The cable is interconnected between a second portion of the strap and the winding reel. The cable loops from the strap to the reel such that winding of the reel retracts the cable to pull the second portion of the strap toward the first portion. The lock is coupled to the first strap second portion. The lock is selectively engageable with the second portion of the strap to relieve tension from the cable. Both cam and plate locks are disclosed.

9 Claims, 8 Drawing Sheets top view
side view
FIXED
LOCK
14
18
20
30
32
34
36
38
40
42
44
46
48
50
52
54 top view
side view

HARNESS TIGHTENING SYSTEM

PRIORITY CLAIM

This application is a continuation-in-part of U.S. patent application Ser. No. 10/903,491 filed, Nov. 26, 2004 now abandoned which claims priority from provisional application Ser. No. 60/552,218 filed Mar. 11, 2004 and 60/515,305 filed Oct. 28, 2003. Each and all of the foregoing applications are incorporated by reference as if fully set forth herein.

FIELD OF THE INVENTION

This invention relates generally to harness adjustment and tightening systems and, more specifically, to winding reel adjustment systems for packs and other body harnesses.

BACKGROUND OF THE INVENTION

Harnesses and harness tighteners are used on backpacks and belt packs, as well as various climbing and safety harnesses, and sports harnesses, such as for kite-boarding. The user needs a close-fitting secure harness, especially about the waist, without discomfort. Current methods of tightening a waist harness involve a strap looped through a buckle. The strap extends from the hip portion of the waist belt under a buckle first member, around a second member, and back under the first member. The arrangement creates a friction hold on the strap. The strap is loosened by pulling outwardly on the lateral side of the buckle to release the friction on the buckle first member.

Tightening the buckle precisely and securely may be difficult. Two hands may be necessary to snuggly secure the hip belt. One hand is used to pull the strap portion between the hip pad and the buckle towards the buckle, while the other hand pulls the loose end of the strap to slide the strap through the buckle. The user must overcome the buckle friction and has little mechanical advantage. Further friction is introduced in tightening since the angle for pulling the strap along its tensioned length is usually ergonomically awkward for the user. Thus the strap is usually pulled at least somewhat out of line. The use of both hands and the difficult tightening usually require the user to stop hiking (or other activities) while he or she tightens the hip belt. On-the-fly tightening is difficult at best.

Therefore, a need exists for a tightening system that pulls in line with the strap direction, is easy to adjust with one hand, achieves a mechanical advantage for secure tightening, and locks securely in place once tightened. The present invention meets these needs as discussed below.

SUMMARY OF THE INVENTION

The present invention provides a harness adjustment system that may be used in various applications including backpacks, windsurf harnesses, kite-board harnesses, mountain climbing harnesses, utility harnesses, backpack shoulder straps, tie-down straps, and various belts for numerous applications. The harness adjustment system includes a first strap, a winding reel, a tension member, and a lock. The first strap has a first portion and a second portion. The winding reel is secured to the first portion. The winding reel has a rotation portion that rotates relative to the first portion. The tension member is interconnected between the second portion and the winding reel. The tension member is engaged by the winding reel rotation portion. The lock is coupled to the first strap second portion. The lock is selectively engageable with the second portion of the strap.

In one aspect of the invention, the first strap first portion, the second portion, and the tension member form a loop. The loop is adjustable in length by adjustment of the tension member with the winding reel. The lock is a rotatably mounted cam having a cam surface that engages the first strap. In another embodiment, the lock includes overlapping plates through which the strap is entrained.

The further aspect of the invention includes a coupler having a first end engaged with the loop. The lock is connected to the coupler to engage the loop. A second strap is also coupled to a second end of the coupler. The second strap extends away from the first strap. A buckle is coupled to the second strap. The system works with a hip belt with the buckle being coupled to the hip belt and the first strap being coupled to the hip belt.

In one aspect of the invention, the tension member includes a cable that is windable on the winding reel. The cable loops from the winding reel to the second portion of the first strap and back to the winding reel. Preferably, cable guides are secured to the first strap first portion and to the first strap second portion for providing a low friction engagement with the cable loop from the winding reel around to the straps and back to the winding reel. Adjustment of the winding reel thus adjusts the hip belt.

In a further aspect of the invention, a second strap is provided that is coupled to the first strap through the coupling member on the opposing side from the lock. A buck is coupled to the second strap and to the hip belt for macro adjustment of the hip belt with the second strap. Micro adjustment then may be carried out with the harness system winding reel.

One aspect of the invention includes the securement of a backpack to the hip belt that includes the harness system described.

In a further aspect of the invention, the lock member includes a rotatable cam having a cam surface engageable with the first elongated strap. The cam member may be rotatably coupled to the coupler member that engages the first strap and the second strap.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENTS

The disclosure of pending application Ser. No. 10/903,491 filed Jul. 30, 2004 is hereby incorporated by reference.

Figure 1:
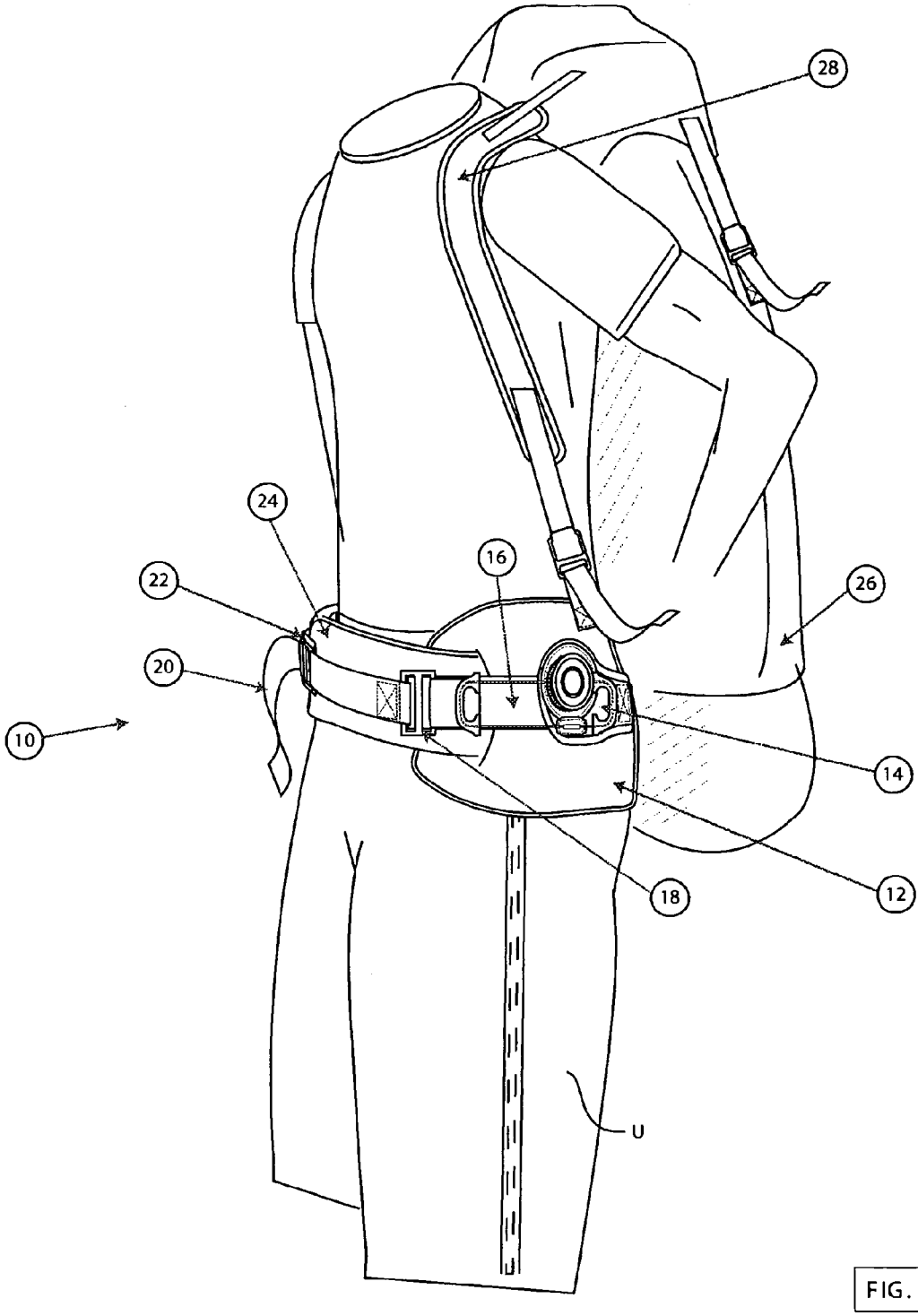
FIG. 1 is a perspective view of the harness system of the present invention used with a backpack secured on a user.

The preferred embodiments of the tightening mechanism of the present invention will now be discussed in connection with FIGS. 1 through 10. As will be appreciated, the tightening mechanism may be used with various harness systems including hip or waist belts for various applications such as backpacking or kite-boarding. The applications are not limited to these specific examples. Thus, FIG. 1 illustrates a preferred embodiment of the present invention as secured on a user "U" to help hold a backpack. A harness 10 is thus provided for this use. Harness 10 includes a hip belt 12 that encircles the user about his or her waist and hips similar to a conventional backpack hip belt.

Hip belt 12 is secured to the user with straps and adjustment mechanisms. An adjuster mechanism 14 is provided that tightens the hip belt about the user in an efficient and easy to use fashion. Adjustment mechanism 14 will be described in further detail below in connection with FIGS. 2 and 3. Adjustment mechanism 14 is secured to a first strap 16 that is fixed to hip belt 12 then loops through a coupler 18 for interconnection with adjustment mechanism 14 and for tightening thereof. A second strap 20 is secured to the opposing side of coupler 18 and extends to the opposite side of the user to be secured with a buckle 22. Buckle 22 also allows for a macro adjustment of harness 10 about the waist of the user. In this preferred embodiment, an abdominal pad 24 is also secured between the user and second strap 20.

As mentioned above, harness 10 is used in this instance for aid in securing a backpack 26 to the back of a user. Backpack 26 includes a bag and a shoulder strap 28 secured at its upper end to the bag and at its lower end to hip belt 12. Obviously, other loads or applications may be used that employ similar harness mechanism shown and described herein as harness 10. The backpack is used for illustrative and exemplary purposes only.

Figures 2A, 2B:
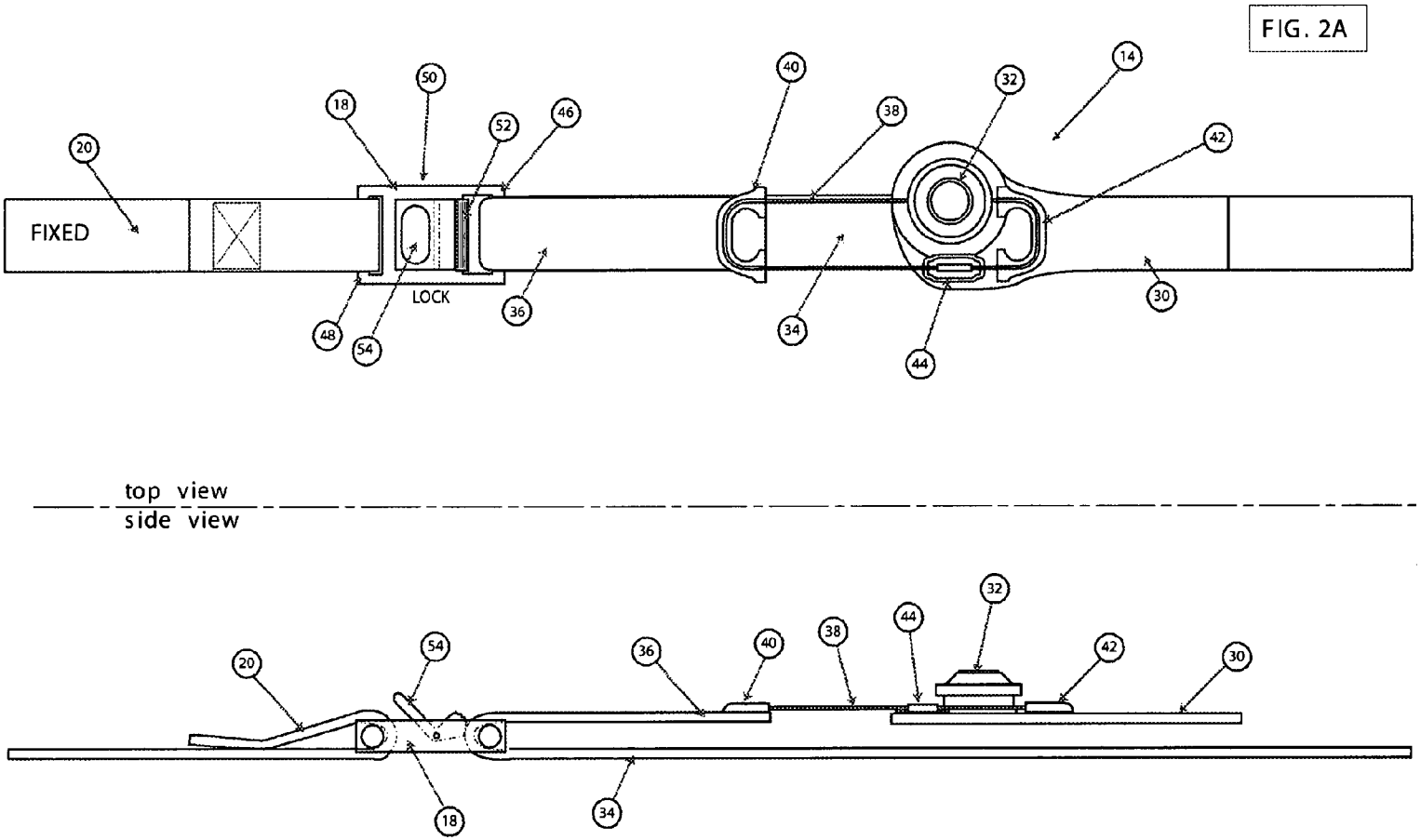
FIGS. 2A and B illustrate the tightening system for the harness of the present invention in a plan view and elevational view.

Referring now to FIGS. 2A and B, adjustment mechanism 14 includes a base member 30 onto which a winding reel 32 is secured. Base member 30 may be of a plastic, composite, fabric, or other material to provide a secure mounting location for reel 32 and to interconnect reel 32 to the remainder of harness 10, either to the hip belt 12, for example, or to another strap mechanism. Alternatively, base member 30 is an integral part of hip belt 12. Base member 30 may be secured to a first strap portion 34 of first strap 16 or may be secured directly to hip belt 12. In the case of direct securement, first strap 16 may also be secured directly to a portion of hip belt 12 at strap first portion 34. In FIG. 2B, base 30 is shown elevated above first strap 16 for illustrative purposes. It may be fixed directly to first strap 16 or to hip belt 12. First strap 16 extends from first portion 34 through coupler 18 and back towards reel 32 at strap second portion 36.

A cable 38 extends from within reel 32 to second portion 36 of first strap 16 so as to couple strap second portion 36 to reel 32. Specifically, cable 38 extends from reel 32 through a medial cable guide 40 which directs cable 38 back towards reel 32 then through lateral cable guide 42 and into reel 32. Medial and lateral cable guides 40 and 42 are "U" shaped in plan view with channels therein to slidably guide cable 38 about a looped path. An intermediate cable guide 44 is also preferably secured adjacent reel 32 and lateral cable guide 42 on base member 30 to help guide cable 38. Both lateral cable guide 42 and intermediate cable guide 44 are preferably secured to base member 30.

When reel 32 is rotated, cable 38 is wound therein such that strap second portion 36 is pulled toward reel 32 for a shortening of the distance between base member 30 and coupler 18. Thus, the easy adjustment of the tightening of the harness is carried out. Loosening is accomplished by releasing reel 32.

Coupler 18 provides a first transverse bar 46 around which first strap 16 may loop back on itself for securement to cable 38 at strap second portion 36. First strap 16 slidably engages first transverse bar 46 such that as strap second portion 36 is pulled, a 2-to-1 mechanical advantage is achieved simply through the interconnection between coupler 18 and first strap 16.

Coupler 18 also includes a second transverse bar 48 at the opposite end thereof to secure second strap 20 thereto. Second strap 20 is preferably looped around second transverse bar 48 and stitched back on itself for a secure fixation to coupler 18.

In the preferred embodiment of the invention, coupler 18 also includes a lock 50 that is rotatably connected to coupler 18 in a mid portion thereof. Lock 50 includes a cam 52 that engages with an outer surface of first strap 16 so as to prohibit slippage of first strap 16 about first transverse bar 46. A release lever 54 is also provided so as to release cam 52 from engagement with first strap 16 as desired. With lock 50 engaging first strap 16, the tension on reel 32 may be released. Alternately, tension may be maintained whereas lock 50 provides an extra measure of security such that the main force pulling on first strap 16 from harness 10 will be effectively transmitted through coupler 18 without undue forces being constantly exerted on adjustment mechanism 14 during use. Thus, for example in various applications such as backpacking or kite-boarding, large intermittent forces may be encountered which may unduly wear on adjustment mechanism 14. In alternate embodiments of the invention, lock 50 may be omitted. When lock 50 is included, release of tension on first strap 16 is accomplished by releasing reel 32's engagement with cable 38 and thereafter pulling release lever 54 to release lock 50 to allow first strap 16 to slide pass first transverse bar 46.

Figure 3B:
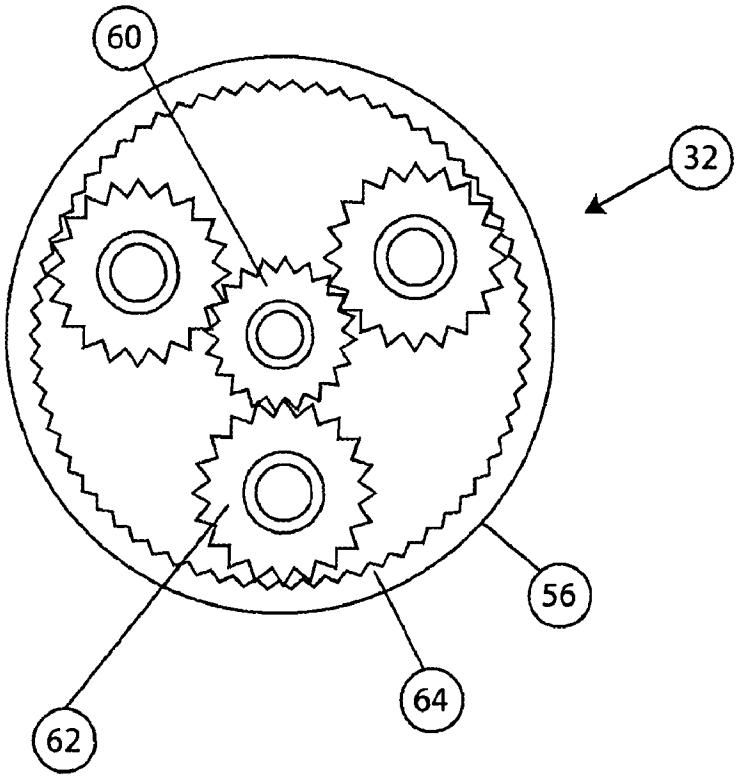
FIGS. 3A and B illustrate in schematic views the basic instruction of the winding reel.
Figure 3A:
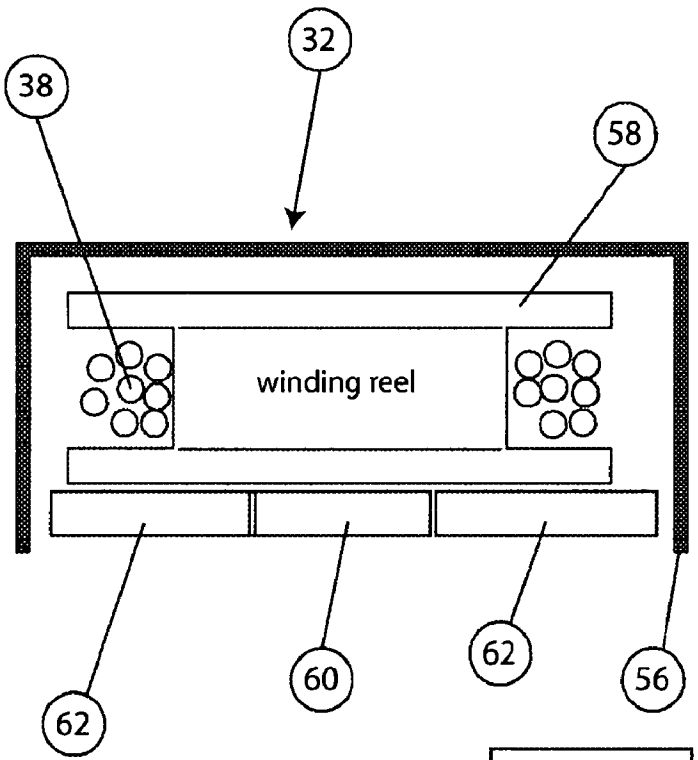

Turning now to FIGS. 3A and 3B, the details of reel 32 will be discussed. Reel 32 is preferably a winding reel such as that produced by Boa Technology, Inc. of Steamboat Springs, Colo. The basic construction and operation of the reel is shown in schematic views in FIGS. 3A and B. Reel 32 includes a spool 58, a housing 58, and gears 60 and 62. Spool 58 holds a portion of cable 38 wound thereabout. The lower portion of spool 58 is secured to a central gear 60. Outer gears 62 surround central gear 60 and are held within a ring gear 64 of housing 56. Also not shown is a ratchet mechanism that holds ring gear 64 from rotation in one direction until released therefrom. Release from the one-way ratchet and pull mechanism as well as from engagement with outer gears 62 is accomplished by lifting housing 56 such that ring gear 64 clears outer gears 62.

Figure 4A:
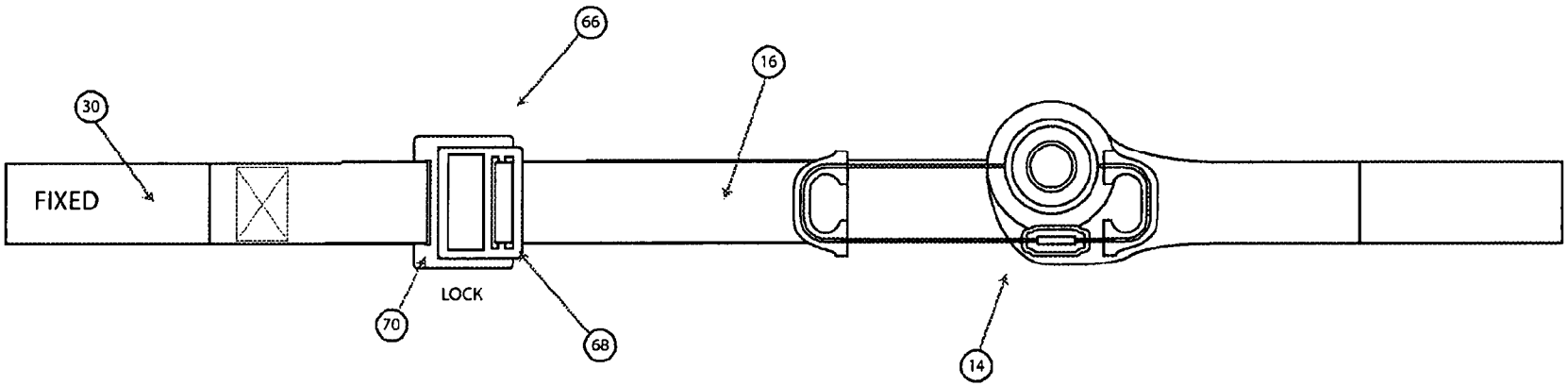
FIGS. 4A and 4B illustrate in plan and side elevational views a preferred harness tightening mechanism with a plate lock.
Figure 4B:
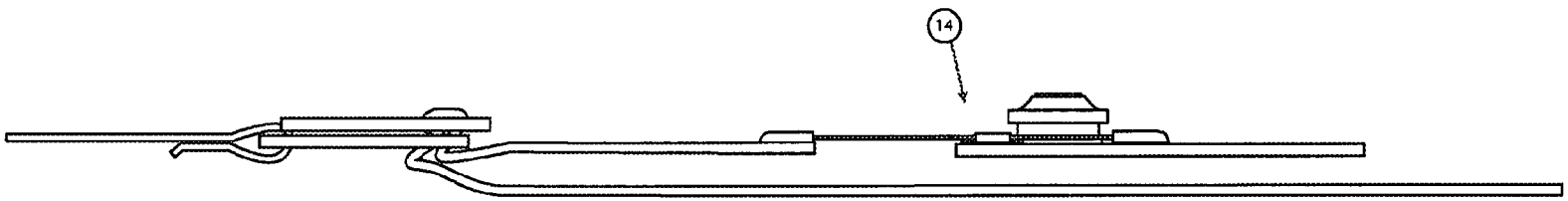

FIGS. 4A and 4B illustrate adjustment mechanism 14 with an alternate plate lock 66 in place of lock 50 that employs a cam. Plate lock 66 is made up of an upper plate 68 and a lower plate 70 through various cross bars of which first strap 16 is entrained.

Figure 5:
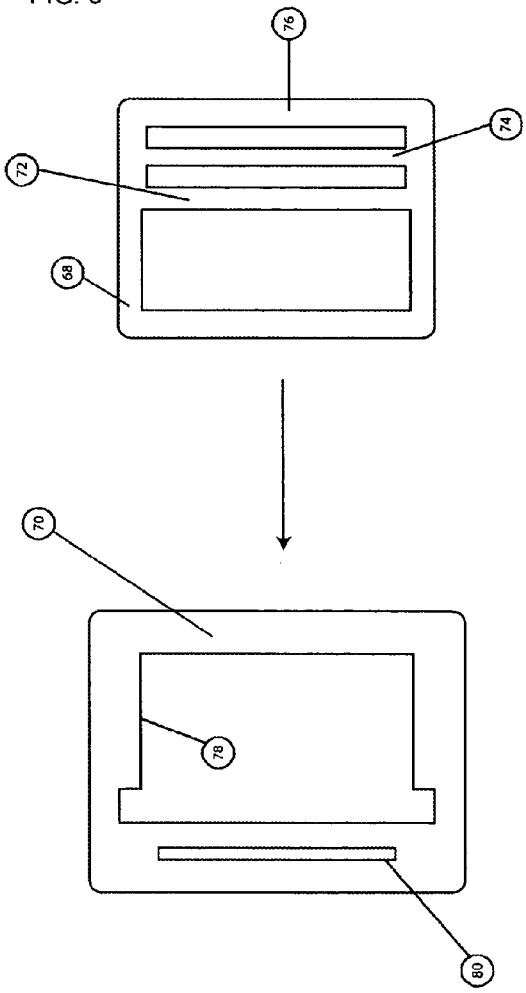
FIG. 5 illustrates the parts of the plate lock.
Figure 6:
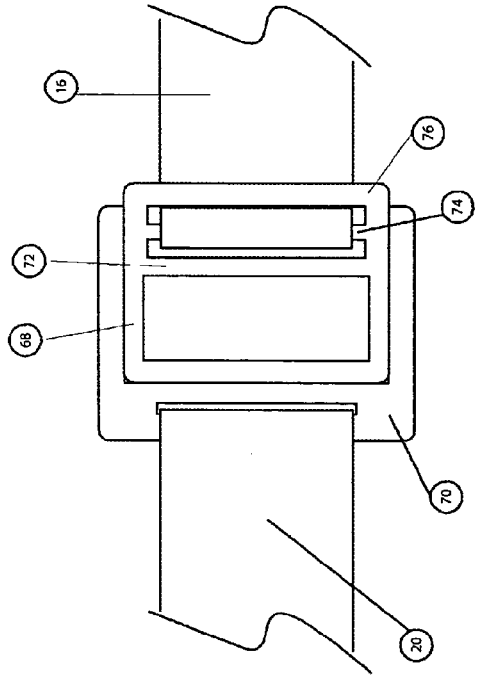
FIG. 6 shows a close-up plan view of the plate lock.

FIGS. 5 and 6 illustrate the details of plate lock 66 and its various pieces along with the entrainment of first strap 16 therethrough. Upper and lower plates 68 and 70 are generally rectangular in plan view with various openings and cross bars therein. They are preferably constructed of metal, but may alternatively be constructed of plastic, composite, or other standard materials. Upper plate 68 includes first, second, and third cross bars 72, 74, and 76, respectively. These cross bars are on one side of upper plate 68.

Lower plate 70 includes a lower plate opening 78 over which upper plate rests, upper plate 68 being larger than lower plate opening 78. Lower plate 70 also includes a second strap opening 80 through which second strap 20 is looped for securement thereto.

An understanding of how first strap 16 is engaged with plate lock 66 can be had by an examination of FIG. 6. Strap 16 extends from its connection to hip belt 12 up through lower plate opening 78 and between first cross bar 72 and second cross bar 74 of upper plate 68. Strap 16 then extends downwardly between second cross bar 74 and third cross bar 76 to then exit plate lock 66 and extend back toward winding reel 32 to be coupled therewith by cable 38.

As strap 16 is tensioned, it is able to slide through upper and lower plates 68 and 70 due to strap 16 pulling on second cross bar 74 to allow free clearance for a passage of strap 16. However, once tension on strap second portion 36 is relieved, the tension on strap first portion 34 slides upper plate 68 such that the portion of strap 16 extending between second cross bar 74 and third cross bar 76 frictionally engages lower plate 70 to inhibit sliding of strap 16 therethrough.

Strap 16 is released from plate lock 66 by lifting on the side of upper plate 68 opposite cross bars 72, 74, and 76.

Figure 7:
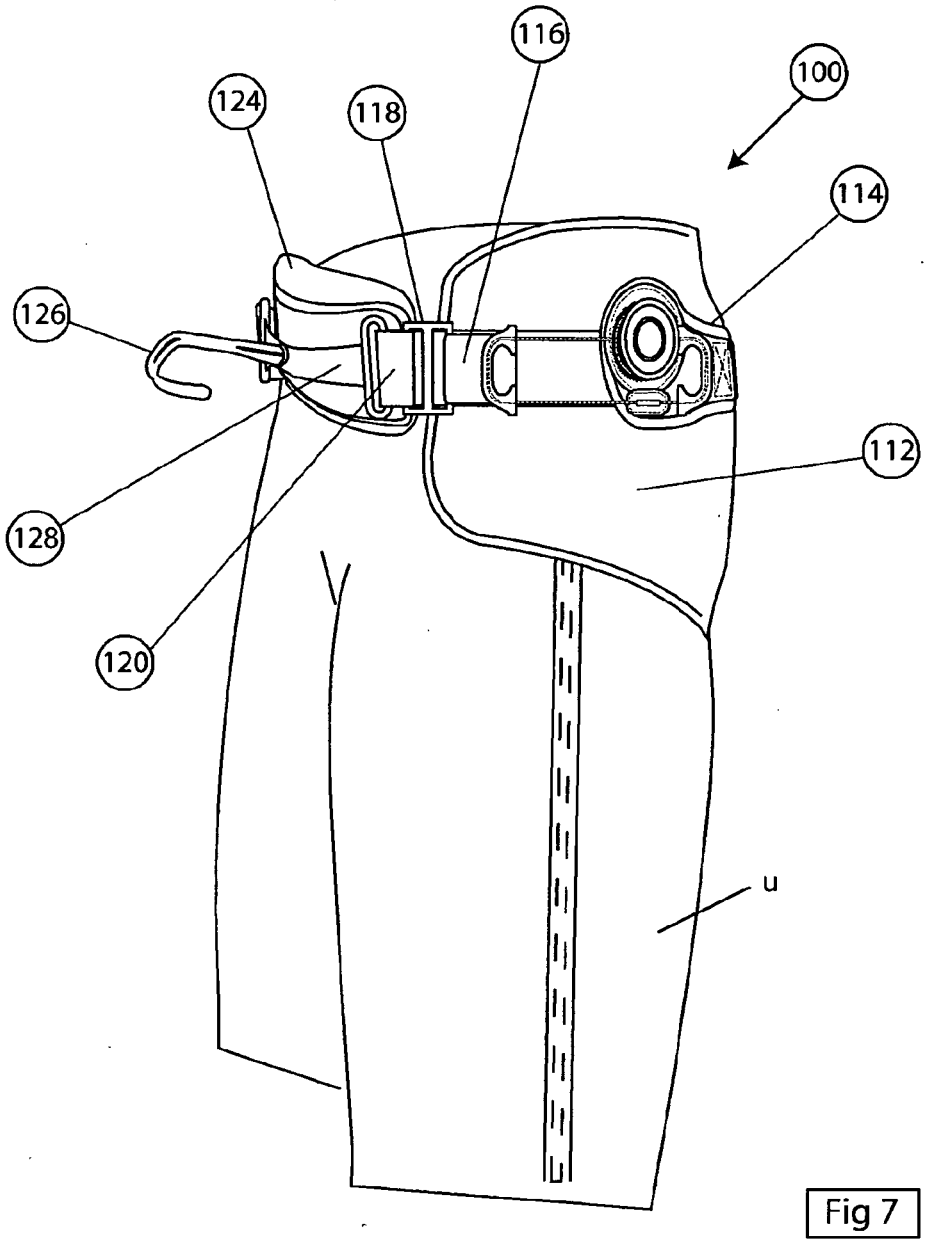
FIG. 7 illustrates a kite-board harness that employs the tightening mechanism of the present invention.
Figure 8:
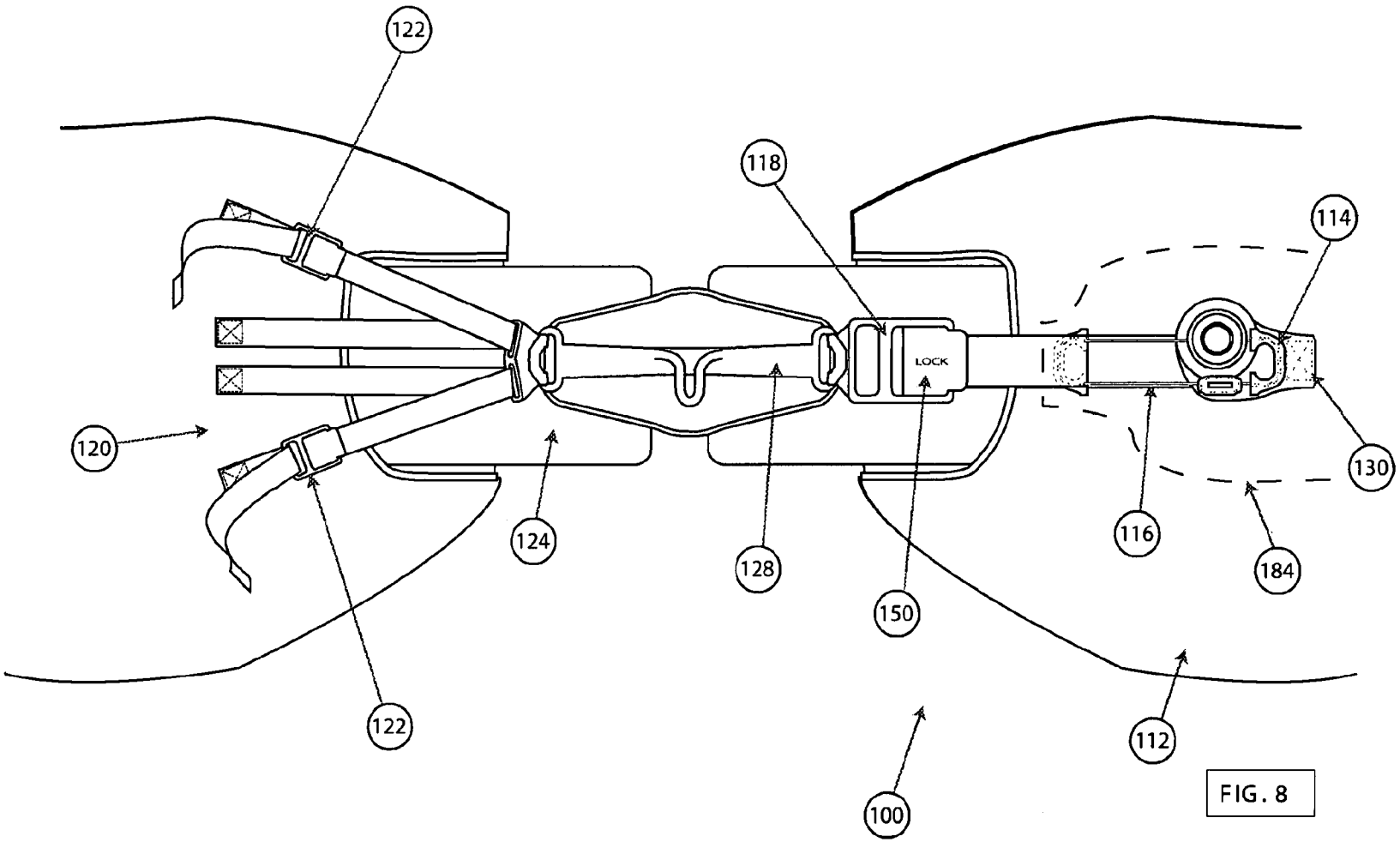
FIG. 8 is a plan view of the front portion of the kite-board harness showing the tightening and locking mechanisms.

Referring now to FIGS. 7 and 8, the tightening mechanism of the present invention will now be described in connection with an application of a kite-board harness. Thus, referring to FIG. 7, a kite-board harness 100 is provided to be secured about a user "U". Kite-board harness 100 includes a hip belt 112 that is configured for comfortable and secure usage for kite-boarding. Hip belt 112 is similar to standard hip belts generally available. Thus hip belt 112 may be constructed with standard outer materials, padding, and boarders. An adjustment mechanism 114 is secured to hip belt 112. Adjustment mechanism 114 is secured to a first strap 116 and a coupler 118 similar to that described above in connection with FIG. 1. A second strap 120 is secured between coupler 118 and a hook coupling 128 that secures a kite-hook 126. Its hook mechanisms are also preferably similar to those standard mechanisms used in the kite-boarding industry. An abdominal pad 124 is secured between hook coupling 128 and the user.

Adjustment mechanism 114 is used in a similar fashion to that described above. Adjustment mechanism 114 may provide micro adjustability and is particularly efficient due to the great mechanical advantage it employs through the looping of strap 116 as well as the mechanical advantage gained with the reel used in adjustment mechanism 114.

Further details of the various components of the invention as employed with a kite-board harness are illustrated in FIG. 8. A base member 130 is secured to hip belt 12 to provide a mounting location for the reel of adjustment mechanism 114. A support member 184 may be under the outer skin or on top of the outer skin of hip belt 12 to disperse the load transmitted through strap 116 and base member 130.

A lock 150 is also provided on coupler 118. In this embodiment, a release lever of lock 150 is in its lock position when flush with the outer face of strap 116. Thus, it will not be unintentionally disengaged as the user must pull outward on the free end of lock 152 release strap 116. However, tightening of strap 116 with adjustment mechanism 114 is accomplished by simply rotating the winding reel. This is due to the cam lock nature of lock 150 which engages strap 116 when it moves toward a loosening direction, but allows strap 116 to pass in a tightening direction. The cam lock mechanism may also be spring loaded to further aid in this function. The spring biases the cam toward an engaged position.

The preferred tightening mechanism on the opposite side of harness 100 from adjustment mechanism 114 is also illustrated in FIG. 8. In this embodiment, second strap 120 includes two straps affixed to hip belt 112 that extend toward hook coupling 128. These straps extend through a second strap coupler that loops the straps back to buckles 122 which are then tightened with tightening straps looped therethrough in a conventional fashion. The angled orientation of second straps 120 allows for a secure positioning of hip belt 112 on the user.

Figure 10A:
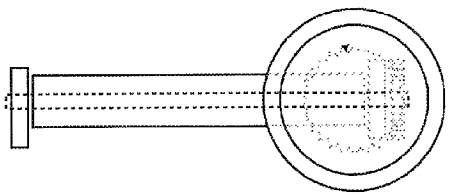
FIGS. 10A and B illustrate plan and side elevational views of the winding mechanism of FIG. 9.
Figure 10B:
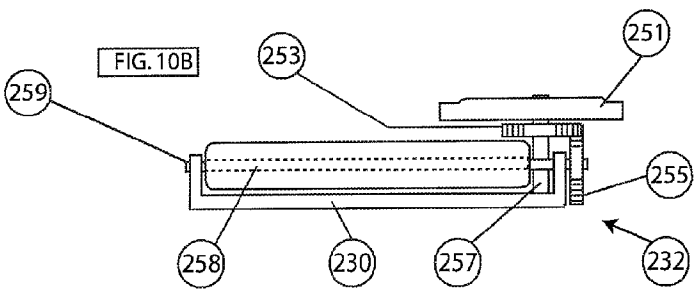
Figure 9:
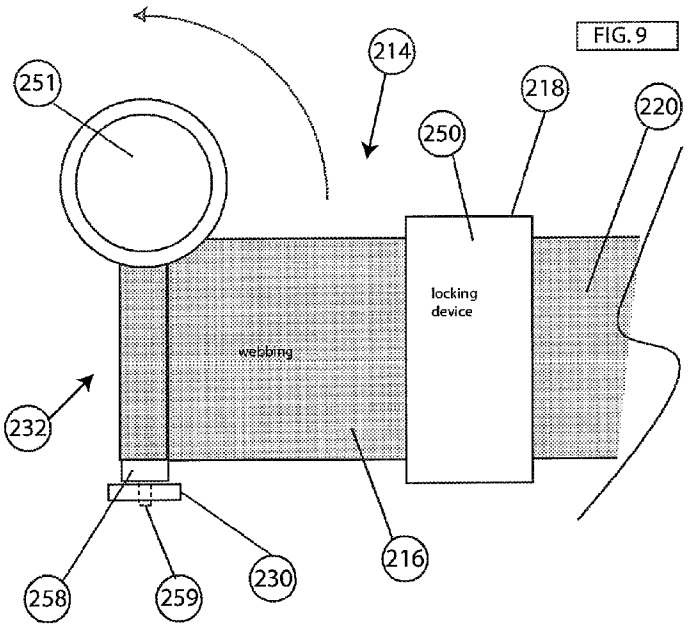
FIG. 9 shows an alternate winding device.

An alternate winding reel tightening mechanism will now be described in connection with FIGS. 9 and 10. This mechanism winds the webbing of first strap 216 directly about a spool on the winding mechanism rather than having an intermediary cable member. Alternately, an intermediary webbing member or other strap member that is wound about the spool may be used. However, you will note that the axis of the spool substantially parallel to the face of first strap 216 rather than normal thereto as in winding reel 32 discussed above. Adjustment mechanism 214 tightens first strap 216 as it is looped back on itself through coupler 218. Thus, tightening of adjustment mechanism 214 brings coupler 218 closer to adjustment mechanism 214. Second strap 220 is secured to coupler 218 for tightening of a hip belt or other device.

Adjustment mechanism 214 is secured on base member 230, which may be secured to a hip belt or other strap or device that requires tightening. A reel 232 includes an adjust wheel 251 that the user operates to turn a spool 258. Adjust wheel 251 includes an axis of rotation that is substantially normal to first strap 216 before it is wound on spool 258. Turning of adjust wheel 251 is translated into turning of spool 258 about a transverse axis thereto through the use of a drive gear 253 and a driven gear 255. Drive gear 253 is keyed to adjust wheel 251 and engages driven gear 255 with beveled gears to then drive wind axle 259 keyed to spool 258. First strap 216, being engaged with spool 258, is thus wound about spool 258 by rotation of adjust wheel 251. A ratchet mechanism, not shown, may be used to hold the position of spool 258, as desired. The ratchet may engage adjust wheel 251 such that when adjust wheel 251 is pulled upwardly away from spool 258, drive gear 253 disengages drive gear 255 to allow spool 258 to release tension on strap 216.

While the preferred embodiments of the invention have been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A harness adjustment system comprising:

a. a first strap having a first portion and a second portion;

b. a winding reel secured to said first portion; said winding reel having a rotation portion that rotates relative to said first portion;

c. a tension member comprising a cable interconnected between said second portion and said winding reel, said tension member being engaged by said winding reel rotation portion, wherein said first strap first portion, said first strap second portion, and the said tension member form a loop, said loop being adjustable in length by adjustment of the tension member with said winding reel;

d. a lock coupled to said first strap second portion, said lock being selectively engageable with said second portion, said lock comprising a rotatably mounted cam having a cam surface that engages said first strap;

e. a coupler having a first end engaged with said loop, said lock being connected to said coupler to engage said loop;

f. a second strap, wherein said coupler further comprises a second end coupled to said second strap, said second strap extending away from said first strap;

g. a buckle coupled to said second strap; and h. a hip belt secured to said first strap, adjustment of said winding reel adjusting said hip belt.

2. The harness adjustment system of claim 1, wherein said buckle is coupled to said hip belt.

3. The harness adjustment system of claim 1, wherein said cable loops from said winding reel to said second portion of said first strap and back to said winding reel.

4. The harness adjustment system of claim 3, further comprising a first cable guide secured to said first strap first portion and a second cable guide secured to said first strap second portion.

5. The harness adjustment system of claim 1, wherein said second strap is coupled to said first strap and said buckle coupled to said second strap is also coupled to said hip belt for macro-adjustment of said hip belt.

6. A hip-belt harness system comprising:

a. a hip belt configured for securement around the waist of a user;

b. a first elongate strap secured to said hip belt;

c. a winding reel secured to said hip belt;

d. a tension member comprising a cable, said cable windable in said winding reel and coupled to said first elongate strap;

e. a coupler member coupled to said hip belt, wherein said first elongate strap is looped through said coupler member from its attachment to said hip belt, an opposite end being secured to said tension member;

f. a backpack secured to said hip belt;

g. a second elongate strap secured to said hip belt and coupled to said first elongate strap, said harness further comprising an adjustable buckle coupled to said second elongate strap for adjustment of said second elongate strap; and h. a lock member comprising a rotatable cam having a cam surface engageable with said first elongate strap.

7. An adjustable harness comprising:

a. a first elongate strap having a first portion and a second portion;

b. a coupler member, said first elongate strap disposed through said coupler member such that said second portion extends back adjacent said first portion;

c. a winding reel coupled to said first portion of said first elongate strap;

d. a tension member that comprises a cable windable on said winding reel, the cable secured between said winding reel and said second portion of said first elongate strap, wherein adjustment of said winding reel moves said tension member for adjustment of said first elongate strap;

f. a lock member coupled to said coupler member, said lock member engageable with said first elongate strap between the first and second portions thereof;

g. a second elongate strap coupled to said coupler member and extending away from said first elongate strap;

h. an adjustment buckle coupled to said second elongate strap;

i. a hip belt secured to said first elongate strap and to said second elongate strap; and j. a low friction guide secured to the said first elongate strap configured to receive the cable.

8. The adjustable harness of claim 7, further comprising a cam lock mechanism engaging said first elongate strap to hold said first elongate strap to relieve tension from said tension member.

9. A belt adjustment system for adjusting the length of a body-encircling belt, the system comprising:

a. a strap extending from the belt, said strap having a first strap portion and a second strap portion continuing from said first strap portion;

b. a winding reel secured to said first strap portion; said winding reel having a rotation portion that rotates relative to said first strap portion;

c. a tension member comprising a cable, the cable interconnected between said second strap portion and said winding reel, said tension member being engaged by said winding reel rotation portion;

d. a lock coupled to said second strap portion, said lock being selectively engageable with said second strap portion;

e. a load carrier secured to the belt; and f. a coupler member secured to the belt, wherein said second strap portion extends from said first strap portion and through said coupler member, said first strap portion extending from said winding reel to said coupler, said second strap portion extending from the coupler back toward said winding reel.

* * * * *